US006657174B1

(12) United States Patent
Olsson

(10) Patent No.: US 6,657,174 B1
(45) Date of Patent: Dec. 2, 2003

(54) METHOD AND DESIGN FOR INCREASING THE FIRING RANGE OF ARTILLERY SHELLS

(75) Inventor: Torbjörn Olsson, Sigtuna (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/129,841

(22) PCT Filed: Oct. 18, 2000

(86) PCT No.: PCT/DE00/02009

§ 371 (c)(1),
(2), (4) Date: Sep. 12, 2002

(87) PCT Pub. No.: WO01/35046

PCT Pub. Date: May 17, 2001

(30) Foreign Application Priority Data

Nov. 10, 1999 (SE) ..... 9904053

(51) Int. Cl.[7] ..... F42B 15/01
(52) U.S. Cl. ..... 244/3.3; 102/501
(58) Field of Search ..... 102/501; 244/3.27, 244/3.3, 3.24

(56) References Cited

U.S. PATENT DOCUMENTS

| | | | | | |
|---|---|---|---|---|---|
| 229,499 | A | * | 6/1880 | Turner | 244/3.27 |
| 399,880 | A | * | 3/1889 | Graydon | 244/3.27 |
| 1,746,397 | A | | 2/1930 | Johnson | |
| 2,055,765 | A | | 9/1936 | Hayden | |
| 2,297,130 | A | * | 9/1942 | Bomar | 244/3.27 |
| 2,324,346 | A | | 7/1943 | Albree | |
| 3,007,411 | A | * | 11/1961 | Piper | 244/3.26 |
| 3,282,216 | A | * | 11/1966 | Calfee | 244/158 A |
| 3,292,879 | A | * | 12/1966 | Chilowsky | 244/3.3 |
| 3,412,962 | A | * | 11/1968 | Killian | 244/130 |
| 4,215,632 | A | * | 8/1980 | Sie | 102/521 |
| 4,674,706 | A | * | 6/1987 | Hall | 244/3.3 |
| 5,164,538 | A | * | 11/1992 | McClain, III | 102/517 |
| 5,196,650 | A | * | 3/1993 | Cytron | 102/521 |

FOREIGN PATENT DOCUMENTS

| | | |
|---|---|---|
| DE | 2136002 | 1/1973 |
| DE | 4135466 A1 | 4/1993 |
| FR | 714676 | 11/1931 |

* cited by examiner

*Primary Examiner*—Michael J. Carone
*Assistant Examiner*—Troy Chambers
(74) *Attorney, Agent, or Firm*—Connolly Bove Lodge & Hutz LLP

(57) ABSTRACT

The present invention relates to a method of increasing the range of air defense and artillery shells of the type which for reasons of firing technology have a rear surface which is at right angles to the shell axis, i.e. most conventional air defense and artillery shells. The invention also includes a design of air defense and artillery shells that corresponds with the said method. The invention is characterized by the rear surface of the shell which at the time of firing is at right angles to the shell axis being reformed to an aerodynamically more advantageous form (5, 9) when it has left the gun barrel and is on the way to the target.

10 Claims, 1 Drawing Sheet

METHOD AND DESIGN FOR INCREASING THE FIRING RANGE OF ARTILLERY SHELLS

FIELD OF THE INVENTION

The present invention relates to a method for increasing the firing range of air-defence and artillery shells of the type which for reasons concerning firing technology have a rear surface which is at right angles to the shell axis, i.e. in principle all conventional air-defence and artillery shells. The invention also includes a design of air-defence and artillery shells that corresponds with the said method.

BACKGROUND ART

It is well known that the rear surface that is at right angles to the axis of the shell while being desirable at firing, has an adverse affect on the shell in the case of long-range firing due to the airflow along the rear edge of the shell causing turbulence which in its turn results in low pressure and drag to the rear of the shell thus limiting the maximum range of the shell.

The base-bleed technique has been much used in recent years to increase the range of air-defence and artillery shells without having to increase muzzle velocity and thereby the size of the propellant charge to a level which the gun in question would not withstand.

The base-bleed technique is based on allowing gas to flow out from the rear surface of the shell preferably during the release of heat, and the flow rate of the gas in such a case shall be at a level that enables the gas flow to eliminate most of the low pressure and the drag caused. Although the base-bleed device is similar to a supplementary rocket motor with its propellant loaded interior chamber and its central flow outlet, its function is totally different from that used in shells which are fitted with supplementary rocket motors known as sustainers to increase firing range. Such rocket motors are loaded with pure rocket propellant and they provide the shell with a velocity increment, while the base-bleed device is loaded with a slow burning propellant which is intended only to eliminate drag during the portion of the shell trajectory the propellant is burning. One of the advantages of the base-bleed technique is that the base-bleed device requires considerably less space in the shell than that required by a supplementary rocket motor, but the base-bleed device does take up space in the shell which could be used for an active load. The base-bleed device futhermore represents a not inconsiderable increase in cost.

SUMMARY OF THE INVENTION

The present invention now offers a simpler, cheaper and less space-consuming solution to the problem of eliminating or at least minimising the disturbing and range-reducing low pressure at the rear of air-defence and artillery shells which at the time of firing have the rear surface at right angles to the axis of the shell.

In accordance with the principle of the invention, the rear surface of the shell which is at right angles to the shell axis is given a more aerodynamically advantageous form as soon as the shell leaves the barrel of the artillery gun from which it is fired. This can be achieved for example by extending the shell at the rear by a protruding conical tail section. The said tail section can thereby consist of an inflatable part initially fitted in the rear section of the shell in compressed form and secured to the shell body, and can be folded out and inflated to the desired form and hardness by the propellant gases from a small propellant charge which is ignited at the required time. Such an inflatable section part can for example be made of Kevlar and remain in a removable cover connected to the shell up to the time it is deployed.

Another conceivable version of the invention is based on the rear surface of the shell itself consisting of a disposable cover which is removed from the shell as soon as the shell has left the barrel, upon which the actual shell rear section is revealed and this has an aerodynamically favourable conical form narrowing progressively to the rear. In this case also, a smaller propellant charge can be used for separating the cover in question.

Both of the basic versions of the invention are now described in more detail in combination with the enclosed figures while the invention in its entirety is defined in the subsequent patent claims.

Detailed Description

Figures 1, 2, 3, 4:
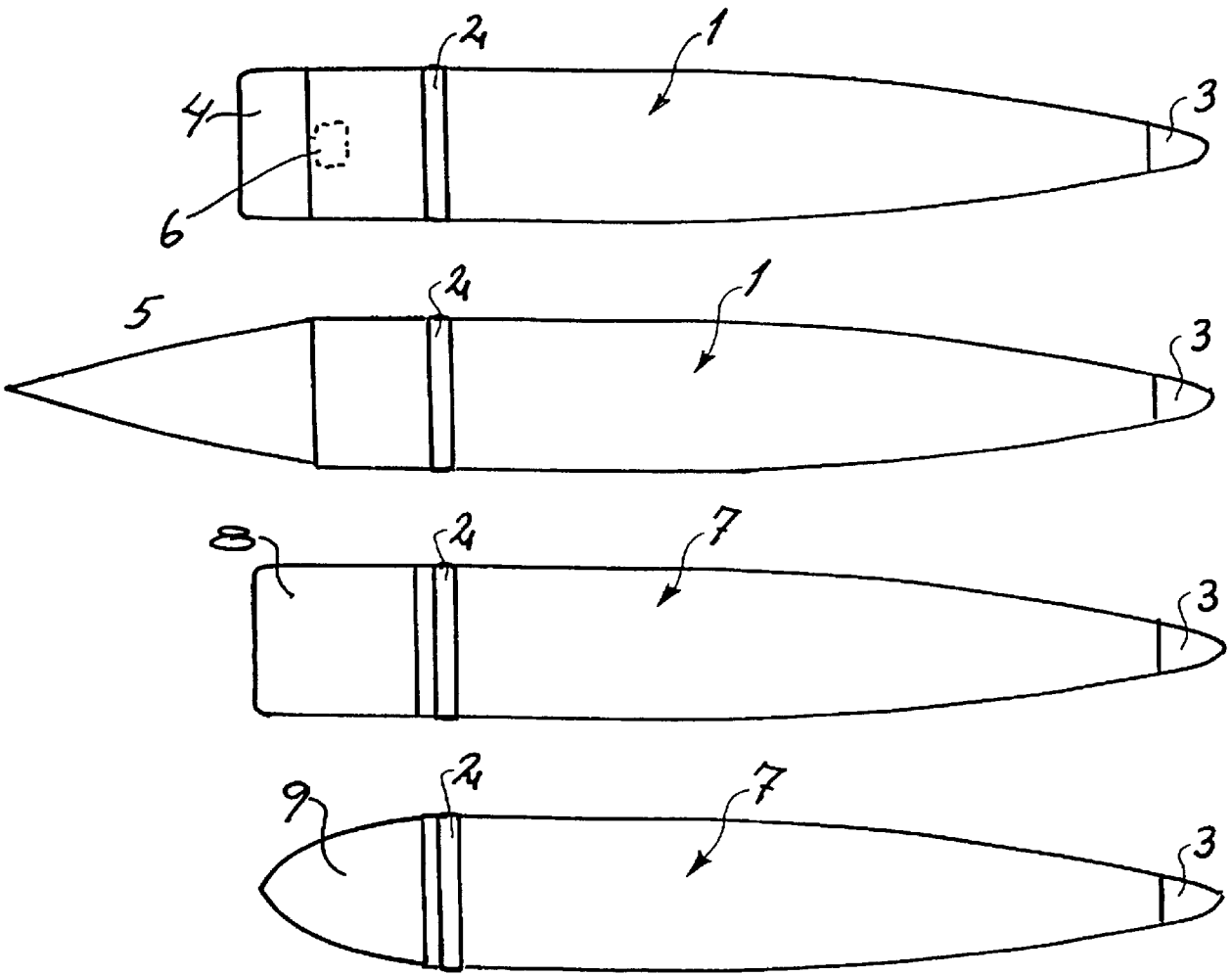
FIG. 1 a first version of a shell before firing in accordance with the invention FIG. 2 the shell in accordance with FIG. 1 in its trajectory towards the target FIG. 3 a second version of the shell before firing in accordance with the invention and FIG. 4 the shell in accordance with FIG. 3 in its trajectory towards the target.

The shell illustrated in FIG. 1 consists of a shell body 1, fitted with a driving band 2, a fuse 3 and a removable cover 4. Inside the cover 4 there is a compressed extension part 5, shown in inflated position in FIG. 2, which remains inside the cover until the shell has left the barrel from which it is fired. The extension part is made of Kevlar and it is inflated by the combustion gases from a propellant charge the position of which inside the shell is indicated by reference 6 in FIG. 1. The propellant charge which also causes the removal of the cover 4, is initiated when the shell leaves the barrel of the weapon from which it is fired.

The shell illustrated in FIG. 3 consists of a shell body 7, a driving band 2, a fuse 3 and a removable cover 8 which differs somewhat from the cover shown in FIG. 1. The cover 8 contains no components and has the sole task of providing the shell which has an aerodynamically rounded-off rear section 9 as shown in FIG. 4, with a rear surface which is at right angles to the shell axis at firing. The cover 8 is ejected by a small charge built into the shell in a manner similar to that illustrated in FIG. 1.

What is claimed is:

1. An artillery shell, comprising:

a shell body;

a tail section, the tail section comprising:

an inflatable part fitted in a rear section of the shell in a compressed state; and a removable cover connected to a rear of the shell body and covering the inflatable part; and a propellant charge in the projectile, wherein the propellant charge is arranged to provide propellant to inflate the inflatable part and wherein the propellant unfolds the inflatable part.

2. The artillery shell of claim 1, wherein a rear surface of the shell is at a right angle to an axis of the shell.

3. The artillery shell of claim 1, comprising:

a fuse, wherein the fuse is arranged to ignite the propellant charge.

4. The artillery shell of claim 1, comprising:

a driving band on the shell body.

5. The artillery shell of claim 1, wherein the inflatable part is located inside the removable cover.

6. A method of firing an artillery shell, comprising:

providing an artillery shell comprising a shell body and a tail section, the tail section comprising an inflatable part fitted in a rear section of the shell in a compressed state and a removable cover connected to a rear of the shell body, the method comprising:

firing the artillery shell from a barrel, and inflating the inflatable part, thereby unfolding the inflatable part.

7. The method of claim 6, wherein inflating the inflatable part comprises:

inflating the inflatable part into a conical tail section.

8. The method of claim 6, wherein inflating the inflatable part comprises:

igniting a propellant charge, the propellant charge inflating the inflatable part.

9. The method of claim 8, wherein the propellant charge is ignited after the shell leaves the barrel.

10. The method of claim 8, wherein igniting the propellant charge cause the removable cover to separate from the shell.

* * * * *